US007258243B2

(12) United States Patent
Ring et al.

(10) Patent No.: US 7,258,243 B2
(45) Date of Patent: Aug. 21, 2007

(54) ARRANGEMENT FOR PREVENTING ENERGY ABSORBING MATERIAL DEGRADATION ON DRAFT GEARS

(75) Inventors: Michael E. Ring, Saint John, IN (US); Howard Sommerfeld, Oak Forest, IL (US)

(73) Assignee: WABTEC Holding Corp., Wilmerding, PA (US)

( * ) Notice: Subject to any disclaimer, the term of this patent is extended or adjusted under 35 U.S.C. 154(b) by 0 days.

(21) Appl. No.: 10/927,912

(22) Filed: Aug. 27, 2004

(65) Prior Publication Data

US 2006/0043044 A1 Mar. 2, 2006

(51) Int. Cl.
*B61G 1/00* (2006.01)

(52) U.S. Cl. ..... 213/75 R

(58) Field of Classification Search ..... 213/75 R, 213/46 R, 62 R, 64

See application file for complete search history.

(56) References Cited

U.S. PATENT DOCUMENTS 2,776,057 A 1/1957 Blattner
3,403,790 A * 10/1968 Zanow ..... 213/22
3,598,249 A * 8/1971 Vickerman ..... 213/8
3,712,479 A 1/1973 Atkinson
3,741,406 A * 6/1973 Anderson ..... 213/22
5,312,007 A 5/1994 Kaufhold et al.
6,446,820 B1 * 9/2002 Barker et al. ..... 213/75 R

FOREIGN PATENT DOCUMENTS

GB 853774 1/1959

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A draft gear assembly includes a yoke and a coupler follower disposed within the yoke. A front compressible resilient member is disposed intermediate the yoke and the coupler follower. A rear compressible resilient member engages a back wall of the yoke at one end and engages a rear follower at a distal end. A center rod extends through the rear compressible resilient member and the rear follower and engages a shortening member. A plurality of stops members are attached to the back wall of the yoke for limiting compression of the rear compressible resilient member during buff travel. The stop members may be extended toward the coupler follower for limiting compression of the front compressible resilient member during draft travel. Alternatively, a center rod or elastomeric pads may be adapted for limiting compression of the resilient compressible members during buff and draft travel. Stops for limiting compression may be also attached to a center sill.

28 Claims, 4 Drawing Sheets

ARRANGEMENT FOR PREVENTING ENERGY ABSORBING MATERIAL DEGRADATION ON DRAFT GEARS

CROSS-REFERENCE TO RELATED APPLICATIONS

This application is closely related to U.S. Pat. No. 6,446,820 entitled "Railcar Draft Gear Assembly and System" and its disclosure is hereby incorporated by reference thereto.

FIELD OF THE INVENTION

The present invention relates, in general, to draft gear assemblies for use in absorbing both buff and draft shocks normally encountered by railway rolling stock during make-up and operation of a train consist on a track structure and, more particularly, this invention relates to a draft gear assembly using elastomeric resilient compression material for absorbing both buff and draft shocks.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

Draft gear assemblies are widely used in United States railway industry to provide protection to a railway car by absorbing shocks in both draft and buff conditions.

The draft gears are installed in alignment with a railway car center sill and typically include a housing having a closed rear end and an open front end, a compressible cushioning means positioned within the closed rear end and a friction cushioning element adopted in the front end and associated with a spring release mechanism for continuously urging the friction cushioning element outwardly from the compressible cushioning means thereby releasing such friction cushioning element after compression of such draft gears.

The commonly used compressible cushioning means is typically either of an all spring configuration as taught by U.S. Pat. Nos. 5,152,409, 5,590,797 and 6,488,162 or of a spring and hydraulic assembly combination as taught by U.S. Pat. No. 3,368,698.

Lately, a new type of draft gear assembly utilizing an elastomeric energy absorbing material has been introduced into service. A particular type of such draft gear assembly, called Twin-Pac, taught by U.S. Pat. No. 6,446,820, utilizes elastomeric pad stacks for absorbing shocks in both draft and buff conditions.

This design includes a rear compressible resilient member disposed between a rear follower and a yoke portion and a front compressible resilient member disposed within the yoke and associated with a coupler follower. A center rod extends through the yoke portion, through the rear compressible resilient member and through the rear follower. Both the front and rear compressible resilient members are comprised of a stack of elastomeric pads. The design does not utilize a steel housing and steel friction members, thus resulting in reduced draft gear assembly weight.

In draft, only the front stack of pads is loaded, as yoke is moving toward the coupler follower which is abutting a pair of front stops, however in buff, both stacks of pads are loaded as the coupler follower is first moving toward the yoke and further causing the yoke to move in a direction of the rear follower which is abutting a pair of rear stops. This design allows for a different amount of draft and buff travel but still falls within the 6.5-inches of total travel required by the AAR M-901 specification. The integral yoke portion can be configured for interface with an E-coupler, an F-coupler, or a rotary dump type coupler.

Testing of the Twin-Pac draft gears according to paragraphs 6.0 and 9.0 of AAR standard M-901G-00 and involving two 70-ton nominal capacity covered hopper cars loaded to maximum gross weight of 220,000 pounds with dry sand resulted in draft gears failure at a speed being over 8 miles per hour and coupler force approaching 1,000,000 pounds. Event though the speed and force parameters exceed requirements of the AAR standard M-901G-00, it is well known that they are applicable during operation on the track.

It has been determined that the draft gear assembly failure was due to over-compression of the elastomeric pad stacks.

Since the design offers an advantage of reduced weight, it is desirable to provide an overtravel protection preventing over-compression of the elastomeric pad stacks and enabling a more reliable operation of the draft gear assembly.

U.S. Pat. No. 5,312,007 to Kaufhold et al. entitled "Slackless Railway Coupler With Draft/Buff Gear" discloses use of the rear compressible resilient member to absorb impact energy during buff conditions in combination with a plurality of guide bars for limiting the compression of the rear compressible resilient member. However, the slackless type coupler does not utilize the yoke as disclosed in U.S. Pat. No. 6,446,820 and does not utilize the front resilient compression member to absorb impact energy in draft conditions.

Therefore, it is desirable to provide an overtravel protection preventing over-compression of the elastomeric pad stacks in both buff and draft conditions.

It is further desirable to achieve such overtravel protection in the most economical method of retrofitting existing draft gears.

SUMMARY OF THE INVENTION

The present invention discloses a draft gear assembly for cushioning buff and draft shocks in a railway car having a coupler member, with such draft gear assembly being disposed within a center sill of such railway car intermediate a pair of front stops and a pair of rear stops. The draft gear assembly includes a yoke with a back wall and a top and a bottom walls extending from the back wall toward the front end of the draft gear assembly, which is disposed adjacent the coupler.

A coupler follower is disposed intermediate the back wall of the yoke and the front end of the draft gear assembly and includes a pair of stop contact surfaces for contact with such center sill front stops and a coupler bearing surface disposed intermediate the stop contact surfaces.

A front compressible resilient member is disposed intermediate the coupler follower and the back wall of the yoke. The front compressible resilient member has a pair of front end elastomeric pads and a plurality of intermediate front elastomeric pads.

A rear compressible resilient member is disposed intermediate the back wall of the yoke and the back end of the draft gear assembly and has a plurality of rear elastomeric pads.

A rear follower is positioned rearward of the rear compressible resilient member.

A center rod may be extending through the rear compressible resilient member and the rear follower and engaging a shortening member.

The draft gear assembly is provided with overtravel protection capability for limiting compression of the rear and front compressible resilient members.

In a first aspect, such overtravel protection includes a plurality of corner stops extending from either the back wall of the yoke or the rear follower for limiting compression of the rear compressible resilient member during buff travel to a distance being equal to full buff travel distance of the draft gear assembly. Such corner stops maybe further extended toward the coupler follower for limiting compression of the front compressible resilient member during draft travel to a full draft travel distance of the draft gear assembly.

In a second aspect, such overtravel protection includes a center rod having a larger middle portion extending through the rear compressible resilient member with a shoulder portion for limiting compression of the rear compressible resilient member during buff travel. Such rod may be further extended into the yoke toward the coupler follower for limiting compression of the front compressible resilient member during draft travel.

In the third aspect, such overtravel protection includes a plurality of stop members attached either internally or externally to each elastomeric pad of the front and rear compressible resilient members.

In a forth aspect, such overtravel protection includes stop members attached to the sides of the center sill external to the rear resilient compression member and engageable with the yoke.

OBJECTS OF THE INVENTION

It is therefore one of the primary objects of the present invention is to provide a draft gear assembly which protects a railway car by absorbing shocks in both draft and buff conditions.

A further object of the present invention is to provide a draft gear assembly having a front and rear elastomeric compressible resilient members.

Another object of the present invention is to provide a draft gear assembly having positive means for limiting compression of the front and rear elastomeric compressible resilient members.

Additional object of the present invention is to provide a draft gear assembly with a front and rear elastomeric compressible resilient members having more reliable operation.

Yet additional object of the present invention is to provide economical means of retrofitting existing draft gear assemblies to limit compression of the front and rear elastomeric compressible resilient members.

These and various other objects and advantages to the present invention will become more apparent to those persons skilled in the relevant art from the following more detailed description, particularly, when such description is taken in conjunction with the attached drawings and the appended claims.

DESCRIPTION OF THE PREFERRED AND ALTERNATIVE EMBODIMENTS

Figure 1:
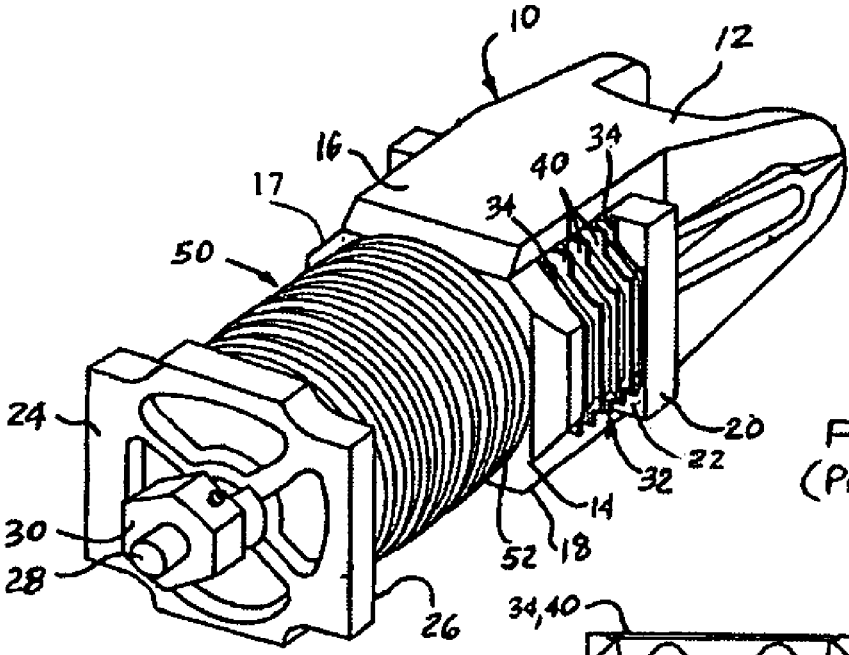
FIG. 1 (PRIOR ART)
FIG. 1 is a perspective view of a prior art draft gear assembly for use with a draft sill and E coupler.

Prior to proceeding to the more detailed description of the present invention, it should be noted that for the sake of clarity identical components, having identical functions have been identified with identical reference numerals throughout the several views, which have been illustrated in the drawing figures.

The draft gear assembly of the present invention overcomes the aforementioned disadvantages by incorporating overtravel protection means disposed within the draft gear assembly or attached to the side walls of the center sill of the railway car for enabling compression of the compressible resilient members that does not exceed predetermined full buff and draft travel distances.

The illustrated embodiments show that the draft gear assembly of the present invention may be used with standard E-couplers and rotary dump couplers, as well as with couplers having E coupler heads and F shanks, for example. For the sake of brevity, the following description will be concerned with the draft gear assembly for use with standard E-coupler as those skilled in the art will readily understand that operation of the draft gears for use with other coupler types will be identical except for configuration of the yoke and coupler followers.

To help the reader in understanding the present invention, a prior art draft gear assembly, generally designated 10, for use with a standard E-coupler is illustrated in FIGS. 1-6. Such draft gear assembly 10 has front and rear ends and includes a yoke 12 with a back wall 14, a top wall 16 and a bottom wall 18 extending toward the front end, a coupler follower 20 with a back surface 22 disposed within the yoke 12, a rear follower 24 with a front surface 26 disposed adjacent the rear end, a center rod 28, a shortening member 30, a front compressible resilient member, generally designated 32, having a pair of front end elastomeric pads 34 and at least one front intermediate elastomeric pad 40, and a rear compressible resilient member, generally designated 50, having at least one rear elastomeric pad 52.

Figure 2:
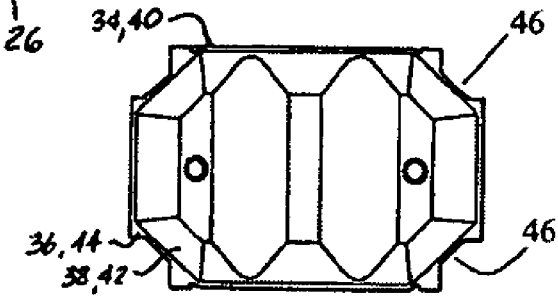
FIG. 2 (PRIOR ART)
FIG. 2 is a front elevation view of end and intermediate pad assemblies of a front compressible resilient member of the prior art draft gear.
Figure 3:
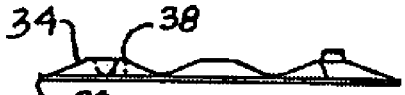
FIG. 3 (PRIOR ART)
FIG. 3 is a top plan view of the end pad assembly of the front compressible resilient member of FIG. 2.
Figure 4:
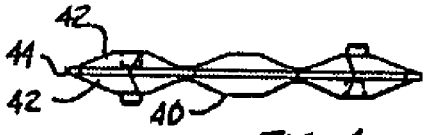
FIG. 4 (PRIOR ART)
FIG. 4 is a top plan view of the intermediate pad assembly of the front compressible resilient member of FIG. 2.

Each front end elastomeric pad member 34, as shown in FIGS. 2 and 3, comprises a steel plate 36 bonded to a single elastomer pad 38. The steel plates 36 of the front end pad members 34 bear against the coupler follower 20 and the back wall 14 of the yoke 12. Each front intermediate pad member 40, as shown in FIGS. 2 and 4, comprises two elastomer pads 42 bonded to a central steel plate 44. The elastomer pads 42 of adjacent front intermediate pad members 40 bear against each other and against the adjacent elastomer pads 38 when stacked to form the front resilient member 32. Each illustrated pad member 34 and 40 of the front resilient member 32 is generally rectangular in elevation view, as shown in FIG. 2 and are adapted with notched corners 46 corresponding to opposed notched corners 17 of the yoke 14.

Figure 5:
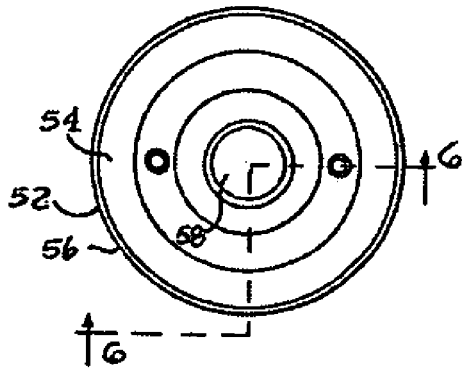
FIG. 5 (PRIOR ART)
FIG. 5 is a front elevation view of a pad assembly of a rear compressible resilient member of the prior art draft gear.
Figure 6:
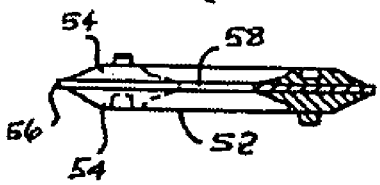
FIG. 6 (PRIOR ART)
FIG. 6 is a view of the pad assembly of the rear compressible resilient member taken along line 6-6 of FIG. 5.

As shown in FIGS. 5 and 6, each rear pad 52 comprises two elastomer pads 54 bonded to a central steel ring plate 56. As shown in FIG. 1, the elastomer pads 54 of adjacent rear elastomer pads 52 bear against each other. Each rear elastomer pad 52 has a through aperture 58 at its center, each aperture 58 having a sufficient diameter for the center rod 28 to pass through. Each illustrated rear elastomer pad 52 for the back resilient member 50 is circular in elevation view, as shown in FIG. 5.

The draft gear assembly of the present invention, generally designated 100, including overtravel protection means, generally designated 200, is best shown in FIGS. 7-14. In a particular reference to FIG. 7, such overtravel protection means 200 includes at least one rear stop member 202 with a first predetermined cross-section longitudinally extending rearward of a back wall 104 of a yoke 102 and being rigidly attached to the back wall 104 by welding or fastening methods. Preferably, such at least one rear stop member 202 is disposed at a corner of the yoke 102 and cooperates with a predetermined shape of a rear compressible resilient member 110. The at least one rear stop member 202 has an end 204 disposed at a first predetermined distance 206 from the front surface 108 of the rear follower 106. During such buff travel, the end 204 will positively contact the front surface 108 preventing overtravel and, more importantly, preventing over-compression of the rear compressible resilient member 110. Preferably, such at least one rear stop member 202 is integral to such yoke 102.

It will be appreciated that such first predetermined distance 206 is equal to a predetermined full buff travel distance of the draft gear assembly 100.

It is preferred that such at least one rear stop member 202 is a plurality of rear stop members 202 rigidly attached to the back wall 104, preferably at each corner thereof, and engaging opposed corners of the rear follower 106. Such disposition of the rear stop members 202 will enable to maintain a second predetermined cross-section of the draft gear assembly 200 to fit a standard draft gear pocket (not shown). It is further preferred that such plurality of rear stop members 202 is integral to the yoke 102.

Those skilled in the art will readily understand that such plurality of rear stop members 202 may be rigidly attached by fastening or welding methods or integral to the rear follower 106 and engage the back wall 104 during buff travel.

Figure 7:
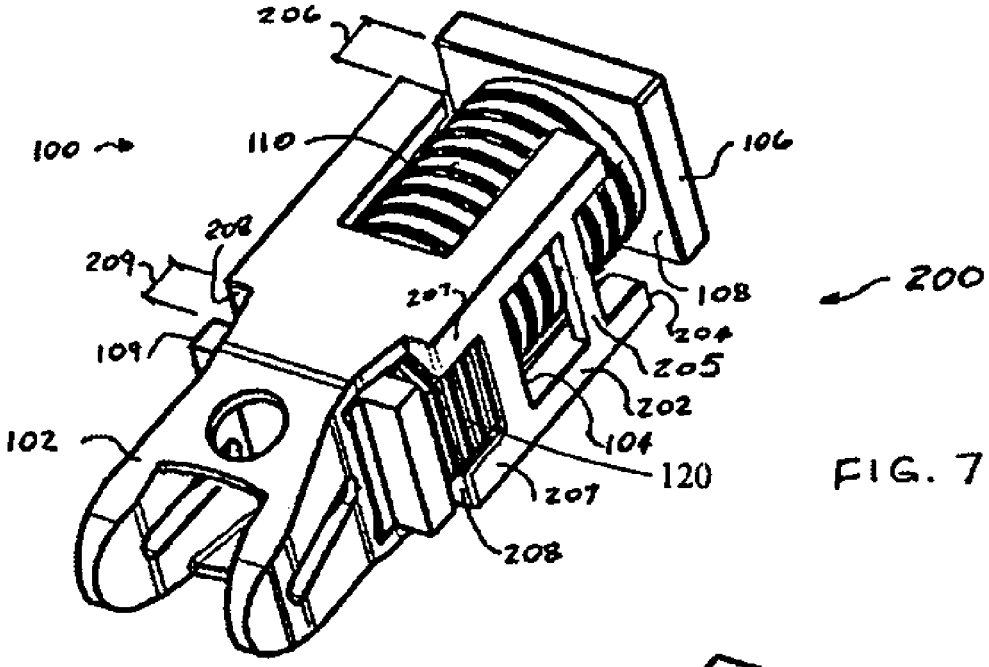
FIG. 7 is a perspective view of a draft gear of the present invention, particularly showing overtravel protection means of a first embodiment of the present invention.

At least a pair of adjacent rear stop members 202 may be adapted with a laterally disposed at least one structural reinforcing means 205, best illustrated in FIG. 7, connecting opposed sides of such longitudinally disposed rear stop members 202. It will be appreciated that such at least one structural reinforcing means 205 may extend the entire length of such at least pair of adjacent rear stop members 202 forming a wall (not shown) partially enclosing the rear compressible resilient member 110 and may further extend the entire length of all such pairs of the rear stop member 202 forming an enclosed rear chamber (not shown) partially enclosing the rear compressible resilient member 110.

In a similar arrangement, either the yoke 102 or the coupler follower 109 is adapted with at least one front stop member 207 having an end 208 disposed at a second predetermined distance 209 from the back surface of the coupler follower 109 or the back wall 104 of the yoke 102. Such second predetermined distance 209 is equal to a predetermined full draft travel distance of the draft gear assembly 100. The at least one front stop member 207 has a third predetermined cross-section to cooperate with notched corners of a front resilient member 120 enabling to maintain such second predetermined cross-section of the draft gear assembly 200.

Those skilled in the art will readily understand that, in buff conditions, the yoke 102 will be positively stopped with respect to the rear follower 106 by the rear stop members 102 and the coupler follower 109 will be positively stopped with respect to the yoke 102 by the front stop members 207. In draft condition, only the yoke 102 will be positively stopped with respect to the coupler follower 109 by the front stop members 207.

Figure 8:
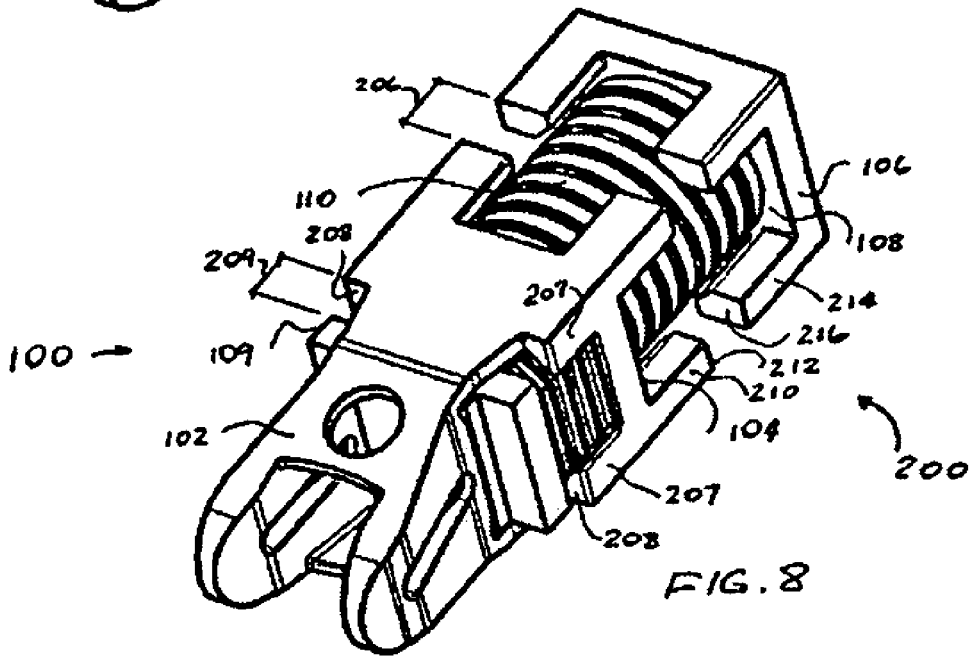
FIG. 8 is a perspective view of a draft gear of the present invention, particularly showing overtravel protection means of a preferred embodiment of the present invention.

In a further preferred embodiment of the present invention, best illustrated in FIG. 8, such overtravel protection means 200 includes at least one first rear stop member 210 rigidly attached or integral to the back wall 104 of the yoke 102 and having a first end 212 and at least one second rear stop member 214 rigidly attached or integral to the rear follower 106 and having a second end 216 disposed oppositely the first end 212 at such first predetermined distance 206.

Figure 9:
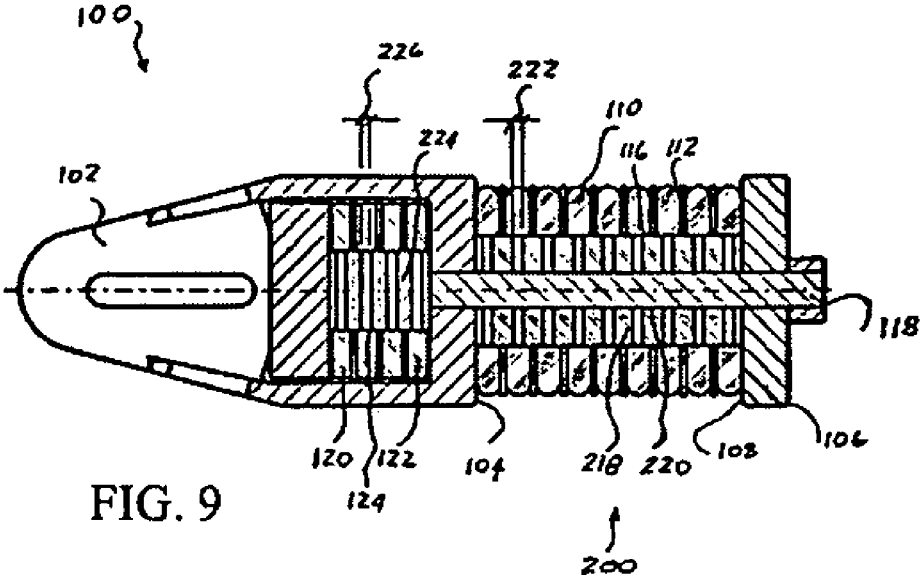
FIG. 9 is a cross-sectional view of a draft gear of the present invention, particularly showing overtravel protection means of a first alternative embodiment of the present invention.
Figure 11:
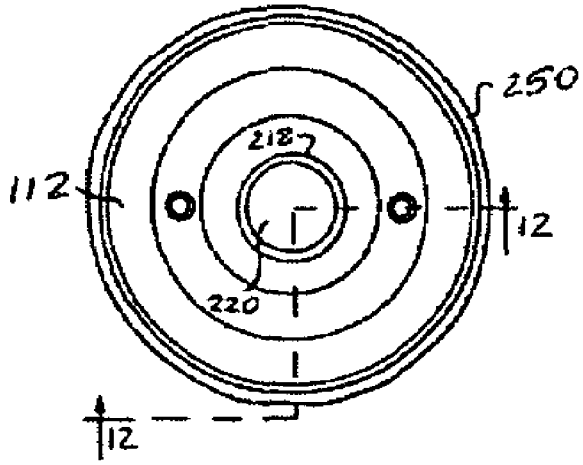
FIG. 11 is a front elevation view of a pad assembly of a rear compressible resilient member of the present invention, particularly showing overtravel protection means of first and third alternative embodiments of the present invention.
Figure 12:
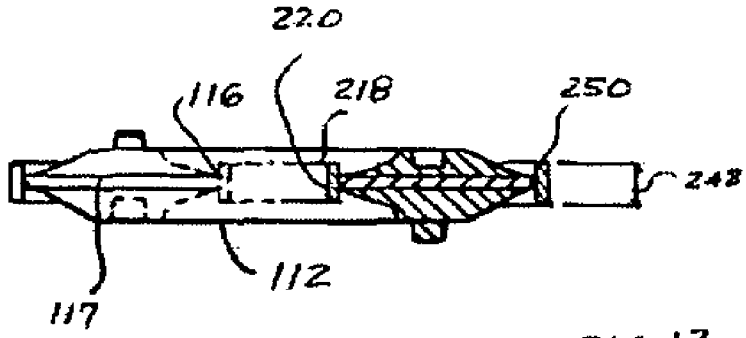
FIG. 12 is a view of the pad assembly of the rear compressible resilient member of the present invention taken along line 12-12 of FIG. 11.

In the first alternative embodiment of the present invention, best illustrated in FIG. 9, the overtravel protection means 200 includes at least one, and preferably, a plurality of first spacers 218, best illustrated in FIGS. 11 and 12, of a first predetermined thickness 248 disposed within the center aperture 116 of the rear elastomer pad 112 of the rear compressible resilient member 110. Such plurality of the first spacers 218 is disposed from each other at a third predetermined distance 222 with plurality of such third predetermined distances 222 being equal to such first predetermined distance 206. Each first spacer 218 is provided with a center aperture 220 sufficient for the center rod 118 to pass through. Preferably, the material of such first spacer 118 is steel.

Figure 13:
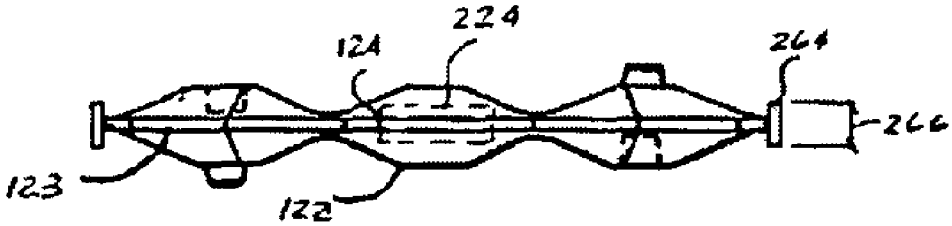
FIG. 13 is a front elevation view of end and intermediate pad assemblies of a front compressible resilient member of the present invention particularly showing overtravel protection means of a third alternative embodiment of the present invention.

In further reference to FIGS. 9 and 13, at least one and preferably a plurality of second spacers 224 of a second predetermined thickness 266 is disposed within a center aperture 124 of the front elastomer pad 122 of the front compressible resilient member 120 for limiting draft travel distance of the draft gear assembly 100. Such plurality of the second spacers 224 is disposed from each other at a forth predetermined distance 226 with plurality of such forth predetermined distances 226 being equal to the predetermined full draft travel distance of the draft gear 100.

Figure 10:
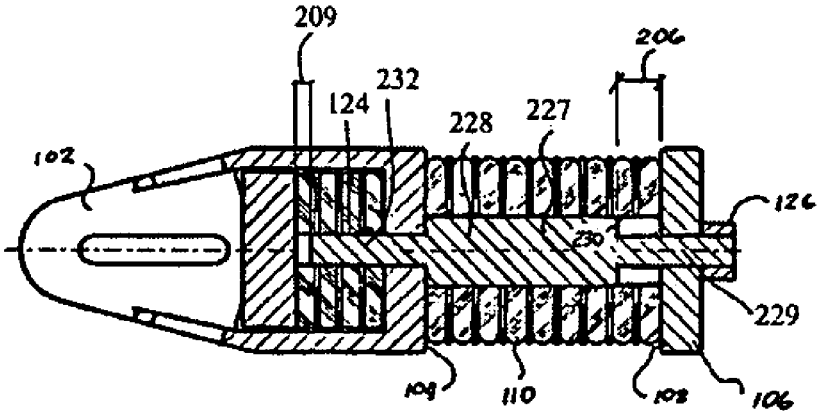
FIG. 10 is a cross-sectional view of a draft gear of the present invention, particularly showing overtravel protection means of a second alternative embodiment of the present invention.

In the second alternative embodiment of the present invention, best illustrated in FIG. 10, the overtravel protection means 200 includes a center rod 227 having a first portion 228 of a first predetermined diameter abutting the back wall 104 of the yoke 102, a second portion 229 of a second predetermined diameter engaging a shortening member 126, and a shoulder portion 230 disposed intermediate such first portion 228 and such second portion 229 and further disposed at such first predetermined distance 206 from the front surface 108 of the rear follower 106. It will be appreciated that orientation of the first and second portions 228 and 229 respectively may be reversed without affecting operation of the draft gear assembly 100.

The center rod 227 may be further provided with a third portion 232 extending into the yoke 102 and having an end disposed at such second predetermined distance 209 from the coupler follower 109.

Those skilled in the art will readily understand that at least one, but preferably a plurality of rod members 227 may be disposed intermediate back wall 104 and rear follower 106 at a corner or corners of the draft gear assembly 100.

The overtravel protection means 200 of the third alternative embodiment, best illustrated in FIGS. 11 and 12, includes at least one first external stop member 250 of the first predetermined thickness 248 attached to the perimeter of a central steel ring plate 242 of the rear elastomer pad 112. Preferably, such first external stop member 250 is a continuous ring 250.

To control the draft travel distance, the overtravel protection means 200 may include at least one second external stop member 264, best illustrated in FIG. 13, having a second predetermined thickness 266 which is attached to a steel plate 123 of the front elastomer pad 122 of the front compressible resilient member 120.

Figure 14:
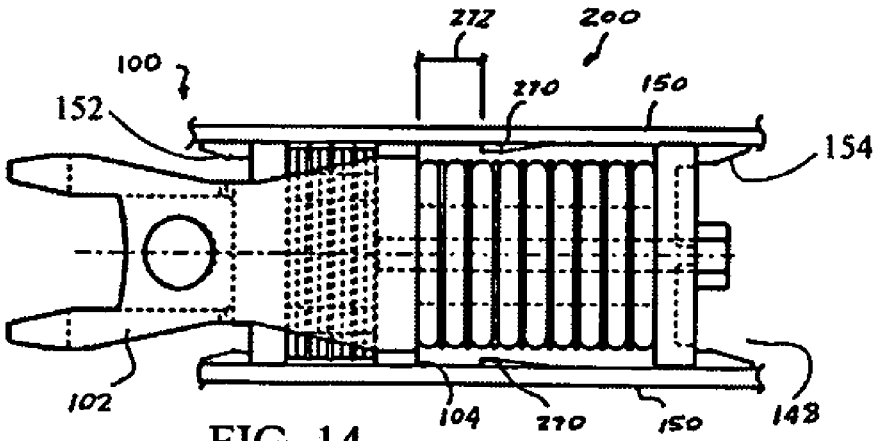
FIG. 14 is a planar view of the draft gear of the present invention, particularly showing overtravel protection means of a forth alternative embodiment of the present invention attached to the side walls of the center sill, partially illustrated.

The overtravel protection means 200 of the forth alternative embodiment, best illustrated in FIG. 14, includes at least one and, preferably, a pair of stop members 270, each rigidly attached to sides 150 of the center sill 148 intermediate the front and the rear stops, 152 and 154 respectively, at a fifth predetermined distance 272 from the back wall 104 of the yoke 102.

Although a presently preferred and various alternative embodiments of the present invention have been described in considerable detail above with particular reference to the drawing FIGURES, it should be understood that various additional modifications and/or adaptations of the present invention can be made and/or envisioned by those persons skilled in the relevant art without departing from either the spirit of the instant invention or the scope of the appended claims.

We claim:

1. A draft gear assembly for cushioning buff and draft shocks in a railway car having a coupler member, said draft gear assembly disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member;

(f) a first overtravel protection means disposed intermediate said yoke and said rear follower and intermediate an exterior surface of said rear compressible resilient member and at least one side surface portion of such center sill for limiting compression of said rear compressible resilient member to a first predetermined distance being equal to a predetermined full buff travel distance; and (g) a second overtravel protection means disposed external of said front compressible resilient member for limiting compression thereof to a second predetermined distance being equal to a predetermined full draft travel distance.

2. A draft gear assembly according to claim 1, wherein said first overtravel protection means includes at least one rear stop member having a first predetermined cross-section, said at least one rear stop member longitudinally disposed rearward of said yoke and having an end disposed at said first predetermined distance from a front surface of said rear follower.

3. A draft gear assembly according to claim 2, wherein said at least one rear stop member is one of rigidly attached and integral to said yoke.

4. A draft gear assembly according to claim 2, wherein said at least one rear stop member is a plurality of rear stop members longitudinally extending from said back wall of said yoke and engageable with opposed surfaces of said rear follower, said plurality of rear stop members being one of rigidly attached and integral to said yoke, said plurality of rear stop members disposed within a second predetermined cross-section associated with said draft gear assembly.

5. A draft gear assembly according to claim 2, wherein said at least one rear stop member is a plurality of rear stop members longitudinally extending from said rear follower and engageable with opposed back wall of said yoke, said plurality of rear stop members being one of rigidly attached and integral to said rear follower, said plurality of rear stop members having ends disposed at said first predetermined distance from said back wall of said yoke, said plurality of rear stop members disposed within said second predetermined cross-section associated with said draft gear assembly.

6. A draft gear assembly according to claim 1, wherein said first overtravel protection means further includes at least one structural reinforcing means laterally disposed rearward of said yoke.

7. A draft gear assembly according to claim 6, wherein said at least one structural reinforcing means at least partially connecting opposed sides of at least one pair of said rear stop members.

8. A draft gear assembly according to claim 7, wherein said at least one structural reinforcing means extends an entire length of each of said at least one pair of rear stop members forming a wall partially enclosing said rear compressible resilient member.

9. A draft gear assembly according to claim 8, wherein said first overtravel protection means includes a plurality of said structural reinforcing means connecting a plurality of said rear stop members forming a rear chamber partially enclosing said rear compressible resilient member.

10. A draft gear assembly according to claim 1, wherein said second overtravel protection means includes at least one front stop member attached to one of said coupler follower and said yoke and having an end disposed at said second predetermined distance from one of said back surface of said coupler follower and said yoke, said at least one front stop member having a third predetermined cross-section.

11. A draft gear assembly for cushioning buff and draft shocks in a railway car having a coupler member, said draft gear assembly disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member; and (f) an overtravel protection means disposed intermediate an exterior surface of said rear compressible resilient member and at least one side surface portion of such center sill for limiting compression thereof to a first predetermined distance being equal to a predetermined full buff travel distance, said overtravel protection means including at least one first rear stop member being one of rigidly attached and integral to said back wall of said yoke, said at least one first rear stop member having a first end and at least one second rear stop member being one of rigidly attached and integral to said rear follower and having a second end disposed oppositely said first end at said first predetermined distance.

12. A draft gear assembly according to claim 11, wherein said overtravel protection means further includes at least one front stop member attached to one of said coupler follower and said yoke and having an end disposed at a second predetermined distance from one of said back surface of said coupler follower and said yoke, said second predetermined distance being equal to a predetermined full draft travel distance.

13. A draft gear assembly for cushioning buff and draft shocks in a railway car having a coupler member, said draft gear assembly disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member; and (f) an overtravel protection means disposed within a center aperture of said at least one rear elastomer pad and being attached thereto for limiting compression of said rear compressible resilient member to a first predetermined distance being equal to a predetermined full buff travel distance.

14. A draft gear assembly according to claim 13, wherein said overtravel protection means includes at least one first spacer having a first predetermined thickness and being disposed internal within said at least one rear elastomer pad of said rear compressible resilient member.

15. A draft gear assembly according to claim 14, wherein said at least one first spacer is a plurality of said first spacers disposed from each other at a third predetermined distance, whereby a plurality of said third predetermined distances is equal to said first predetermined distance.

16. A draft gear assembly according to claim 13, wherein said overtravel protection means further includes a plurality of second spacers having a second predetermined thickness and being disposed internal said at least one front elastomer pad of said front compressible resilient member, said plurality of said second spacers disposed from each other at a forth predetermined distance, whereby a plurality of said forth predetermined distances is equal to a second predetermined distance being equal to a full draft travel distance.

17. A draft gear assembly according to claim 13, wherein said draft gear assembly further includes a center rod extending through said back wall of said yoke, said rear compressible resilient member and said rear follower.

18. A draft gear assembly according to claim 17, wherein said draft gear assembly includes a center aperture disposed in one of said at least one first spacer, said at least one rear elastomer pad and combination thereof for enabling passage of said center rod.

19. A draft gear assembly for cushioning buff and draft shocks in a railway car having a coupler member, said draft gear assembly disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member; and (f) an overtravel protection means attached to an exterior peripheral edge of a centrally positioned steel plate of said at least one rear elastomer pad of said rear compressible resilient member for limiting compression thereof to a first predetermined distance being equal to a predetermined full buff travel distance.

20. A draft gear assembly according to claim 19, wherein said overtravel protection means includes at least one first external stop member of a first predetermined thickness being one of rigidly attached and integral to a perimeter of a central steel ring plate of each of said rear elastomer pads.

21. A draft gear assembly according to claim 20, wherein said at least one first external stop member is a continuous ring.

22. A draft gear assembly according to claim 20, wherein said overtravel protection means further includes at least one second external stop member of a second predetermined thickness being one of rigidly attached and integral to a perimeter of a central steel ring plate of each of said front elastomer pads.

23. A draft gear assembly for cushioning buff and draft shocks in a railway car having a coupler member, said draft gear disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member;

(f) a center rod extending through said back wall of said yoke, said rear compressible resilient member and said rear follower; and (g) an overtravel protection means disposed internal within said rear compressible resilient member and extending through a center aperture of said at least one rear elastomer pad for limiting compression thereof to a first predetermined distance being equal to a predetermined full buff travel distance.

24. A draft gear assembly according to claim 23, wherein said overtravel protection means includes said center rod having a first portion of a first predetermined diameter, a second portion of a second predetermined diameter longitudinally disposed adjacent said first portion, and a shoulder portion disposed intermediate said first portion and said second portion and being disposed at said first predetermined distance from one of front surface of said rear follower and said back wall of said yoke.

25. A draft gear assembly according to claim 24, wherein said overtravel protection means further includes a third portion of said center rod extending into said yoke and having an end disposed at a second predetermined distance from said coupler follower, said second predetermined distance being equal to a predetermined full draft travel distance of said draft gear assembly.

26. A draft gear assembly according to claim 23, wherein said overtravel protection means includes a plurality of said center rod members longitudinally disposed intermediate said yoke and said rear follower externally of said rear compressible resilient member.

27. A draft gear assembly for cushioning buff and draft shocks in a railway car having a coupler member, said draft gear disposed within a center sill of such railway car intermediate a pair of front stops and a pair of rear stops, said draft gear assembly having front and back ends and comprising:

(a) a yoke having a back wall and a top and a bottom walls extending from said back wall toward said front end;

(b) a coupler follower disposed intermediate said back wall of said yoke and said front end of said draft gear assembly, said coupler follower including a pair of stop contact surfaces for contact with such center sill front stops and a coupler bearing surface disposed intermediate said stop contact surfaces;

(c) a front compressible resilient member disposed intermediate said coupler follower and said back wall of said yoke and having at least one front elastomer pad;

(d) a rear compressible resilient member disposed intermediate said back wall of said yoke and said back end of said draft gear assembly and having at least one rear elastomer pad;

(e) a rear follower positioned rearward of said rear compressible resilient member; and (f) an overtravel protection means rigidly attached to a predetermined portion of such center sill of a railway vehicle and disposed intermediate said yoke and said rear follower, said overtravel protection means contacting at least a portion of said yoke during movement of said draft gear assembly.

28. A draft gear assembly according to claim 27, wherein said overtravel protection means includes at least one stop member rigidly attached to a side of such center sill intermediate such front and such rear stops and disposed at a fifth predetermined distance from said back wall of said yoke, said fifth predetermined distance being equal to predetermined full buff travel distance.

* * * * *